US006446676B1

(12) United States Patent
Magri et al.

(10) Patent No.: US 6,446,676 B1
(45) Date of Patent: Sep. 10, 2002

(54) MULTICOMPONENT CROSS-PIECE FOR LOW-NOISE HEDDLE FRAMES IN WEAVING LOOMS

(75) Inventors: Ezio Magri, Vilminore di Scalve; Eugenio Sarzilla, Gazzaniga, both of (IT)

(73) Assignee: Nuova O.M.V. S.r.L., Bergamo (IT)

( * ) Notice: Subject to any disclaimer, the term of this patent is extended or adjusted under 35 U.S.C. 154(b) by 0 days.

(21) Appl. No.: 09/899,132

(22) Filed: Jul. 6, 2001

(30) Foreign Application Priority Data

Jul. 6, 2000 (IT) ..... MI00A1527

(51) Int. Cl.[7] ..... D03C 9/06
(52) U.S. Cl. ..... 139/92
(58) Field of Search ..... 139/92

(56) References Cited

U.S. PATENT DOCUMENTS 2,874,726 A 2/1959 Kaufmann
3,434,505 A 3/1969 Koch
4,508,145 A * 4/1985 Bowen et al. ..... 139/92
4,901,767 A * 2/1990 Koch ..... 139/92
5,183,082 A * 2/1993 Baumann ..... 139/92
5,297,589 A * 3/1994 Baumann ..... 139/91
5,819,810 A * 10/1998 Kramer et al. ..... 139/91

FOREIGN PATENT DOCUMENTS

EP 0 770 722 A1 5/1997

* cited by examiner

*Primary Examiner*—Andy Falk
(74) *Attorney, Agent, or Firm*—Young & Thompson

(57) ABSTRACT

A cross-piece for heddle frames of weaving looms includes an aluminum outer portion (1) with a box-like structure and a thin, solid, steel inner portion (2) to which a heddle support rail (8) is fixed. The outer portion (1) comprises a cavity (5) for housing a connecting end of the inner portion (2) which is separate and distinct therefrom and the two portions (1, 2) are fixed together in position by two profiled strips (3, 4) of plastic material which are respectively resilient and rigid and are arranged on either side of the connecting end of the inner portion (2). The rigid profiled strip (4) is suitable for snap-engagement with a boss (7) provided inside the cavity (5) of the outer portion (1), allowing a stable and rigid connection between the portions (1, 2).

13 Claims, 3 Drawing Sheets

MULTICOMPONENT CROSS-PIECE FOR LOW-NOISE HEDDLE FRAMES IN WEAVING LOOMS

BACKGROUND OF THE INVENTION

1. Field of the Invention

The present invention relates to a multicomponent cross-piece used in the manufacture of heddle frames for weaving looms and in particular low-noise and low-cost heddle frames for high-speed looms.

2. Description of the Related Art

As is well-known to persons skilled in the art, heddle frames are devices used in weaving looms in order to obtain—by means of their alternating movement actuated by the weave machine in a vertical or horizontal plane perpendicular to the weaving plane—the movement of groups of warp yarns in accordance with a predefined weaving pattern. The movement of the heddle frames is synchronized with the insertion of the weft yarn and has an amplitude proportional to the distance between the beating-up point of the reed and the heddle frame in question, so as to obtain an angular opening of the shed which is constant in all the frames.

SUMMARY OF THE INVENTION

A Heddle frames are formed by two side-pieces which form the guides for the alternating movement of the frame and by two cross-pieces on which thin rods made of steel or other material (i.e. the heddles) are mounted, each of said heddles supporting one or more warp yarns. In order to obtain the frame structure, the side-pieces and the cross-pieces are fixed together at right angles at the four corners of the frame in a perfectly rigid manner—so as to prevent any possible deformation of the frame during operation—and at the same time can be easily disassembled to allow insertion or extraction of the desired number of heddles for each operation.

With the improved performance of modern weaving looms, in particular the increase in the operating speed, it is of particular importance to reduce the weight of the masses performing an alternating movement and therefore also that of the heddle frames, so as to ensure that the heddle frames are able to withstand the fatigue resulting from the characteristic alternating and pulsating movement during operation thereof.

According to the prior art, therefore, various solutions have been proposed in an attempt to achieve a better compromise between the characteristics of lightness and resistance to mechanical stresses, with the use, in addition to or in place of the conventional iron-based metallic materials, of lighter materials such as aluminium, light alloys, expanded plastics, composite materials and the like, as will be briefly illustrated below with particular reference to the structure of the cross-pieces to which the present invention relates.

The cross-pieces of the known type all have a similar generic configuration, comprising a relatively thick, box-like, outer portion—intended to provide the frame with the necessary strength and an adequate flexural and torsional rigidity and moreover form the zone for securing of the side-pieces—and a thin solid inner portion—intended to form the heddle support element—usually in the form of a lug projecting from one of the sides of the outer portion and provided at its free end with a heddle support rail often in the form of a metal section. A first conventional type of cross-piece which has a low weight, is a cross-piece the two portions of which are formed by a single extruded piece of aluminium or other light alloys. This type of cross-piece provides excellent results when it is used for the formation of heddle frames intended for low or medium speed looms, while it has too short a working life in high-speed looms, such as air looms for example. The high fatigue stresses to which the cross-piece is subject in these types of looms in fact lead to deformations or breakages of the cross-piece, in particular in the joining zone between the outer box-shaped portion and the thin, solid, inner portion of the cross-piece.

In the art, therefore, numerous other types of cross-pieces have been proposed where the cross-pieces are made with a combination of different materials which are assembled with particular processes, the object of which is precisely to ensure, for the same weight or an even lower weight, a greater structural resistance of the cross-piece. Cross-pieces provided with this new structural design may be divided into different homogeneous categories including in particular: a first category which comprises frames where the cross-piece is formed by sheets of carbon fibre which are assembled by means of gluing to a core made of expanded polyurethane or provided with a honeycomb structure (see, for example, EP-A-770,722); a second category, which comprises frames where the cross-piece is formed by a shell structure made of thin, laser-welded, sheet metal which is formed and assembled about a core made of expanded polyurethane or provided with a honeycomb structure (IT-A-MI98A002853); and, finally, a third category which comprises frames in which the cross-pieces are made using new materials known as "poltrudes" which are obtained by means of a process involving the extrusion of epoxy resins or other synthetic materials on a lamellar carbon-fibre matrix.

All the latest generation frames formed using the cross-pieces from the different categories briefly described above are able to achieve a marked increase in the resistance of the frames to alternating stresses and therefore a possible parallel increase in the maximum speed of the looms with which these frames may be used without giving rise to breakages or other types of drawbacks.

Moreover, these frames, precisely because of the particular materials used and the complicated production processes, have a very high manufacturing cost, which has greatly influenced the spreading thereof in the market, and also are not entirely devoid of drawbacks. The very structural rigidity which characterises them is, in fact, the cause of a low degree of intrinsic structural damping of the vibrations such that basically this type of heddle frame has a noise level which is decidedly higher than that of conventional aluminium extruded frames. It is pointed out, in this connection, that the noisiness of the heddle frames is essentially due to the fact that the heddles are inserted into the rails of the cross-pieces with a fairly large amount of play—in order to assist the weaving loom operator who frequently has to move the entire heddle assembly or part of it for maintenance operations or variations in the article—and this results in a continuous series of knocking of the heddles against either one of the two opposite rails to which they are fastened, said knocking which occurs during the alternating movement of the frame resulting precisely in the noisiness of the said frame.

The object of the present invention is therefore to provide a new type of cross-piece for the formation of heddle frames which allows the use of the said frames in high-speed looms, without creating problems of high cost and noisiness which are characteristic of the latest generation of frames illustrated above.

This object is achieved, according to the present invention, by means of a cross-piece for heddle frames of weaving looms, of the type comprising a thick outer portion having a box-shaped structure and a thin, solid, inner portion to which a heddle support rail is fixed, characterized in that said outer portion and said inner portion are formed by separate and distinct sections which are fixed together in position by one or more elements which are made of material which is soft or has a high mechanical hysteresis and which are arranged between said sections.

According to a characteristic feature of the invention, said seoarate and distinct sections may be made of metallic materials or composite materials, for example of the various types described above, provided that they have an adequate rigidity for withstanding the load imparted by the warp yarns via the heddles, without undergoing major deformation.

According to a characteristic feature of the invention, said outer portion comprises a cavity for housing a connecting end of said inner portion.

According to another characteristic feature of the invention, said elements made of material which is soft or has a high mechanical hysteresis consist of two profiled strips of plastic material with suitable mechanical characteristics, arranged on either side of the connecting end of said inner portion to the outer portion of the cross-piece, so as to prevent any direct contact between said portions.

According to a further characteristic feature of the invention, said profiled strips of plastic material comprise a profiled strip made of resilient material and partially covering the connecting end of the inner portion and a profiled strip made of rigid material and force-fitted between said inner portion and said outer portion, compressing said profiled strip made of resilient material and snap-engaging with a rib of the outer portion.

BRIEF DESCRIPTION OF THE DRAWINGS

Further characteristic features and advantages of the present invention will, however, emerge more clearly from the following description of a preferred embodiment thereof, illustrated with reference to the accompanying drawings in which.

DESCRIPTION OF THE PREFERRED EMBODIMENTS

Figures 1A, 1B:
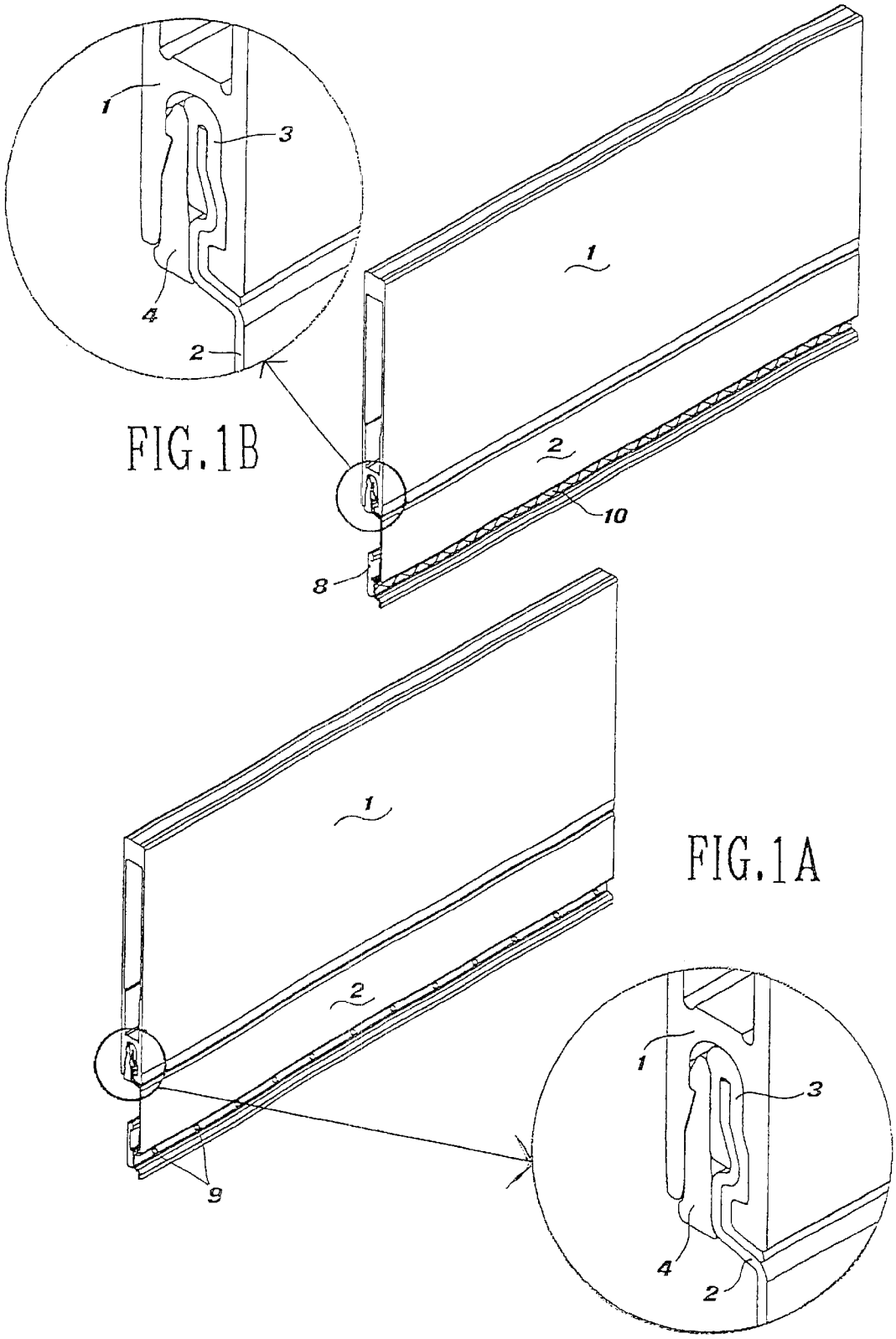
FIG. 1A is a perspective and cross-sectional view, with an enlarged detail, of a portion of the cross-piece according to a first embodiment of the present invention.
FIG. 1B is a perspective and cross-sectional view, with an enlarged detail, of a portion of the cross-piece according to a second embodiment of the present invention.
Figure 2:
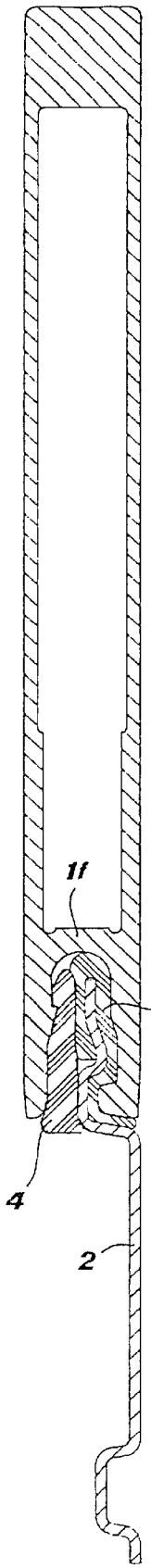
FIG. 2 is a cross-sectional view, on a larger scale, of the cross-piece according to the present invention, without the heddle fastening rail.

As can be clearly seen from the drawings, the cross-piece T according to the present invention consists of a section 1 with a box-like structure—preferably an aluminium or light-alloy extruded part with a closed rectangular cross-section or a section made of composite materials—which forms the outer part of the cross-piece, and a thin solid section 2—preferably made of steel—which has the fretted form shown in the drawings and which forms the inner portion of the cross-piece. The section 2 may obviously also be made of composite materials and in particular materials based on carbon fibres, the sole requisite for the sections 1 and 2, in addition to the necessary lightness, being that they have an adequate rigidity to withstand the load imparted by the warp yarns via the heddles, without undergoing major deformations. Here and below, when referring to the "outer" or "inner" portion of the cross-piece, this is intended to refer to the position occupied with respect to the finished heddle frame, i.e. complete with two cross-pieces and two side-pieces.

The sections 1 and 2 are assembled together by means of forced engagement, with the insertion of two profiled strips made of a material which is soft or has a high mechanical hysteresis, which show a damping effect on the vibrations imparted by the heddles to the section 2. Said profiled strips may be made from a suitable plastic material of the single or dual component types, using an extrusion or injection process known per se. Preferably, the profiled strip 3 is made of a resilient plastic material and the profiled strip 4 is made of a rigid plastic material. Specific materials suitable for the profiled strips 3 and 4 are, respectively, for example, rubber and polyethylene.

In order to obtain a perfectly stable connection between the sections 1 and 2 and at the same time an extremely fast assembly thereof, the section 1 has, on the side where connection occurs with the section 2, a cavity 5 for housing a connecting end of the section 2. The cavity 5 is formed by extensions of the two opposite sides of the section 1, in addition to the end wall if which defines the box-shaped zone of said section 1. In order to provide a particularly stable force-fitted connection, said extensions comprise, on their side directed towards the inside of the cavity 5, respectively, an engaging tooth 6 and a gripping boss 7.

The section 2, as mentioned, is preferably formed by means of profiling from a flat metal sheet, and its outer end for connection to the section 1 comprises a longitudinal depression 2*a*, the shape of which is such as to mate precisely with the tooth 6 of the cavity 5, obviously leaving a sufficiently large gap to allow insertion of the abovementioned profiled strip 3 made of resilient plastic material. At the end opposite to that engaging with the tooth 6, the profiled strip 3 is folded onto itself, in the particular pocket-like configuration shown in the drawings, and is then mounted onto the connecting end of the section 2 so as to cover both the side of the section 2 directed towards the tooth 6 and a first part of the opposite side.

The connection between the section 2 and the section 1 is finally completed by the profiled strip 4 made of rigid plastic material which has a generally wedge-shaped cross-section terminating, in the tapered zone, in a groove 4s directed towards the boss 7. The profiled strip 4 is in fact inserted between the section 1 and the section 2, in the zone opposite to that occupied by the profiled strip 3, until it snap-engages on he boss 7, being locked in position and compressing the connecting end of the section 2 and the profiled strip 3 arranged around it against the opposite wall of the cavity 5. In this way, a play-free connection between the depression 2*a* of the section 2 and the tooth 6 of the section 1 is ensured, with adequate compression of the profiled strip 3, ensuring perfect stability of the said connect-on.

Figure 5:
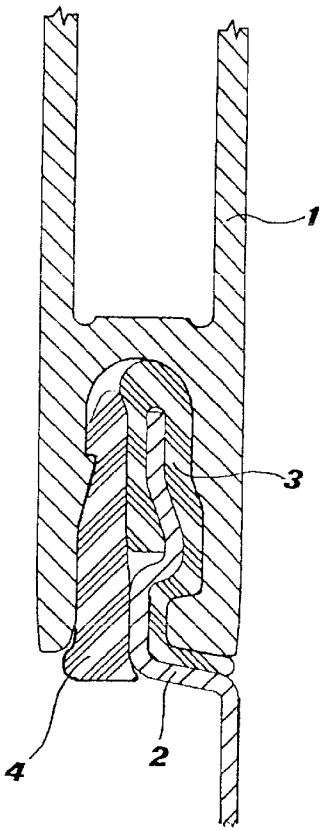
FIG. 5 is a view, similar to that of FIG. 5, once assembly of the cross-piece has been completed.
Figure 4:
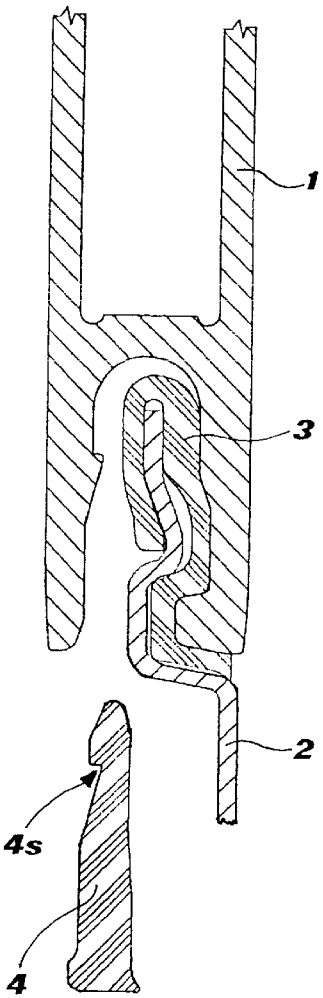
FIG. 4 is a view, similar to that of FIG. 3, of a second assembly step.
Figure 3:
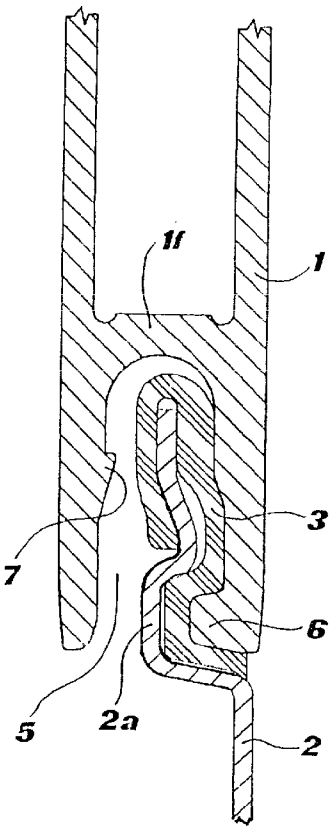
FIG. 3 is a cross-sectional view, on a further enlarged scale, of the detail relating to the force-fitted connection between the two portions of the cross-piece, during a first assembly step.

Assembly of the cross-piece according to the present invention is easy, quick and does not require any special tool. The various assembly steps are shown in FIGS. 3 to 5. During a first step (FIG. 3), the profiled strip 3 is in fact mounted on the connecting end of the section 2 and the latter is then inserted into the cavity 5—which operation is facilitated by the pocket-like configuration of the profiled strip 3 which prevents any possible extraction or misalignment of the profiled strip 3 relative to the section 2 during handling of the latter—causing engagement of the depression 2*a* with the tooth 6. Then, the profiled strip 4 is fully inserted (FIG. 4) into the remaining free zone of the cavity 5 and compressed inside the latter, thus causing adequate compression of the profiled strip 3 and finally snap-engagement of the groove 4*s* onto the boss 7 of the section 1 (FIG. 5), thus producing both stable locking of the sections 1 and 2 and perfect alignment thereof. By accurately determining the thicknesses of the profiled strips 3 and 4 it is in fact possible to lock, without play, the section 2 in the region of both the tooth 6 and the boss 7, thus ensuring the desired alignment thereof with the section 1.

Finally, prior to the operation of assembly of the sections 1 and 2, a thin plate 8 is fixed onto the end of the section 2 opposite to that for connection to the section 1 and in the region of a rib located on the section itself, said plate thus forming the heddle support rail. The plate 8 must be made of a material with a high surface hardness so as to withstand adequately the knocks imparted by the heddles, for example a metallic material such as steel or a composite material such as a material based on carbon fibres. Fixing of the plate 8 may be performed by means of rivets 9 or by means of a laser weld 10 or using the other techniques already known for these types of fixtures.

With the cross-piece described above it is possible to achieve all the predefined objects of the invention, obtaining notable advantages compared to cross-pieces of the prior art. It should be noted in particular that the various components of the cross-piece, as regards both the sections 1 and 2 and the profiled strips 3 and 4, are made from low-cost materials which are widely used and readily available commercially. Moreover, both the process for manufacture and the process for assembly of the cross-piece are extremely simple, such that the overall cost of the cross-piece may be kept within very low values, thus achieving a primary object of the invention.

The cross-piece thus conceived also has a mass substantially equivalent to that of a cross-piece of conventional ultralight frames consisting entirely of aluminium extruded parts and only slightly greater than the mass of more recently designed cross-pieces made of composite materials.

These excellent results, in terms of cost and reduced mass, have been obtained without affecting in a negative manner the mechanical characteristics and duration of the cross-piece. The cross-piece according to the present invention has, in fact, a considerable structural rigidity, owing to the mutual co-operation between the section 1, which has an excellent resistance to the torsional forces, and the section 2, which has an excellent resistance to the flexural forces induced in the plane of the cross-piece by the tractional force of the heddles and the reaction of the two end sidewalls. The presence of the plastic material which forms the profiled strips 3 and 4 does not influence negatively the overall rigidity of the cross-piece, in view of the small thicknesses which characterize these profiled strips, allowing moreover small local deformations which prevent the possible formation of dangerous localised stresses and therefore ensuring a long working life of the cross-piece.

Finally, the cross-piece according to the present invention is also characterized by a fairly low noise level, thus also achieving this object of the invention. The vibrations and the knocks imparted by the heddles to the plate 8 and therefore to the steel section 2 are not in fact transmitted to the aluminium section 1 since they are dampened significantly by the profiled strip 3 made of resilient plastic material located between said sections; any phenomenon of resonance of these knocks and vibrations inside the box-shaped hollow zone of the section 1 is therefore entirely eliminated, said resonance being precisely one of the greatest sources of noisiness of the cross-pieces of the known type.

The present invention has been described with particular reference to preferred embodiments thereof, but it is clear that the scope of protection is not limited thereto, but extends to all the possible variants within the competence of a person skilled in the art, provided that they remain within the teachings disclosed in the accompanying claims.

What is claimed is:

1. Cross-piece for heddle frames of weaving looms, of the type comprising a thick outer portion (1, 2) having a box-like structure and a thin, solid, inner portion to which a heddle support rail (8) is fixed, characterized in that said outer portion (1) and said inner portion (2) are formed by separate and distinct sections which are fixed together in position by one or more elements (3, 4) which are made of material which is soft or has a high mechanical hysteresis and which are arranged between said sections.

2. Cross-piece for heddle frames according to claim 1, wherein said separate and distinct sections (1, 2) are made of metallic materials or composite materials.

3. Cross-piece for heddle frames according to claim 2, wherein said sections (1, 2) have an adequate rigidity for withstanding the load imparted by the warp yarns via the heddles, without undergoing major deformation.

4. Cross-piece for heddle frames according to any one of claims 1 to 3, wherein said outer portion (1) of the cross-piece comprises at least one cavity (5) for housing a connecting end of said inner portion (2) of the cross-piece.

5. Cross-piece for heddle frames according to claim 4, wherein said elements made of material which is soft or has a high mechanical hysteresis consist of two profiled strips (3, 4) of plastic material, arranged on either side of the connecting end of said inner portion (2) to the outer portion (1) of the cross-piece, so as to prevent any direct contact between said portions (1, 2) of the cross-piece.

6. Cross-piece for heddle frames according to claim 5, wherein said profiled strips (3, 4) extend over the entire length of the cross-piece.

7. Cross-piece for heddle frames according to claim 5 or 6, wherein said profiled strips made of plastic material comprise a profiled strip (3) made of resilient plastic material and partially covering the connecting end of the inner portion (2) and a profiled strip (4) made of rigid plastic material and force-fitted between said inner portion (2) and said outer portion (1), compressing said profiled strip (3) made of resilient material.

8. Cross-piece for heddle frames according to claim 7, also comprising an engaging tooth (6) and a gripping boss (7) which are respectively formed on the opposite inner sides of said housing cavity (5) of the outer portion (1) and extending longitudinally over at least part thereof, the connecting end (2*a*) of said inner portion (2) comprising a longitudinal depression (2*a*) constructed to engage with said tooth (6), with the interposed arrangement of the profiled strip (3) made of resilient plastic material, and the profiled strip (4) made of rigid plastic material comprising a groove (4*s*) constructed to snap onto said gripping boss (7).

9. Cross-piece for heddle frames according to any one of the preceding claims, wherein said outer portion (1) is formed by a section made of aluminium or a light alloy.

10. Cross-piece for heddle frames according to any one of the preceding claims, wherein said inner portion (2) is formed by a steel section.

11. Cross-piece for heddle frames according to any one of the preceding claims, wherein said inner portion (2) is formed by a section made of a material based on carbon fibres.

12. Cross-piece for heddle frames according to any one of the preceding claims, wherein said profiled strip (3) made of resilient plastic material is rubber.

13. Cross-piece for heddle frames according to any one of the preceding claims, wherein said profiled strip (4) made of rigid plastic material is polyethylene.

* * * * *